US007266933B2

(12) United States Patent
Pasek

(10) Patent No.: US 7,266,933 B2
(45) Date of Patent: Sep. 11, 2007

(54) SHEET MATERIAL HANDLING DEVICE

(76) Inventor: Mark E. Pasek, 9030 S. 84th Ave., Hickory Hills, IL (US) 60457-1308

( * ) Notice: Subject to any disclaimer, the term of this patent is extended or adjusted under 35 U.S.C. 154(b) by 745 days.

(21) Appl. No.: 10/825,392

(22) Filed: Apr. 14, 2004

(65) Prior Publication Data

US 2005/0229506 A1 Oct. 20, 2005

(51) Int. Cl.
*E04D 15/00* (2006.01)
*E04F 21/00* (2006.01)
*E04G 21/14* (2006.01)

(52) U.S. Cl. ..... 52/749.1; 52/127.1; 52/126.1; 52/127.2; 52/645; 52/651.1; 52/DIG. 1; 248/460; 248/454

(58) Field of Classification Search ..... 52/749.1, 52/749.14, 127.1, 122.1, 126.1, 127.2, 645–646, 52/651.1, DIG. 1; 248/125.8, 129, 101, 248/157, 351, 354.1, 460, 453, 454, 441.1; 403/109.1, 64; 108/110, 107; 269/296, 269/76; 414/11; 254/3 C, 4 C
See application file for complete search history.

(56) References Cited

U.S. PATENT DOCUMENTS 2,720,430 A * 10/1955 Meng et al. ..... 52/645
2,883,073 A * 4/1959 Morris ..... 414/11
2,982,379 A * 5/1961 Fisher ..... 52/111
3,165,367 A * 1/1965 Herman ..... 312/231
3,181,711 A * 5/1965 Stockton ..... 414/11
3,221,837 A * 12/1965 Fisher ..... 182/115
4,165,856 A * 8/1979 Wiseheart ..... 248/449
4,339,219 A * 7/1982 Lay ..... 414/11
4,569,176 A * 2/1986 Hedgepeth et al. ..... 52/645
4,599,832 A * 7/1986 Benton et al. ..... 52/118
4,728,065 A * 3/1988 Coote ..... 248/129
4,856,749 A * 8/1989 Habermann ..... 248/448
5,908,207 A * 6/1999 Wilson ..... 281/45
6,508,448 B1 1/2003 Stewart

* cited by examiner

*Primary Examiner*—Robert Canfield
*Assistant Examiner*—Chi Q. Nguyen
(74) *Attorney, Agent, or Firm*—Douglas W. Rudy

(57) ABSTRACT

A sheet material handling device for assisting a drywall installer in installing sheet material, such as drywall or gypsum board, in an overhead location such as a ceiling of a structure. The device includes base and a pivoting sheet support that is adjustable in several planes to help locate the device relative to the job site and the ceiling in the job site. The drywaller assembles the device, places a sheet of drywall on the device, raises the sheet of drywall into position using the device, secures the pivoting sheet support and then fastens the drywall to the ceiling joists.

20 Claims, 5 Drawing Sheets

SHEET MATERIAL HANDLING DEVICE

BACKGROUND OF THE INVENTION

1. Field of the Invention

The present invention pertains primarily to a sheet material handling device for assisting an installer in installing sheet material, such as drywall or gypsum board, in an overhead location such as a ceiling of a structure. The handling device locates the sheet material so that the sheet material can be fastened to ceiling joists by the installer with out the need for assistance from a second crew member.

2. Description of the Prior Art

There are devices used to assist a drywall installer in positioning and restraining large sheets of drywall material against ceiling joists during the installation process of installing ceiling drywall. The basic design of such devices is a T-shaped tool that has an upstanding vertical pole attached to a transverse spreader. The drywall installation team, of at least two workers will position a sheet of drywall material below the ceiling joists and then one of the workers will position the T-shaped tool to hold the sheet of drywall in position while the second installer screws or nails the sheet of drywall to the studs. After the sheet is securely fastened to the ceiling joists the T-shaped tool is removed and positioned for use on a subsequent sheet of drywall material.

BRIEF SUMMARY OF THE INVENTION

A device for positioning a sheet of material, such as a sheet of drywall, in close proximity to overhead structural elements, such as ceiling joists, is provided. The device allows one person to position and then attach what is normally an unwieldy panel of sheet material, to overhead anchor points. The device includes an adjustable frame and a pivotable support frame carried by the adjustable frame. The pivotable support frame supports the sheet of material and is pivotally swung upwardly toward the ceiling. With the sheet of material proximate the ceiling joists a worker can then fasten the sheet of material to the joists using screws, drywall nails, glue or other fastening means.

The device, appropriately modified, may also be used to support lighting fixtures, ventilation ducts, fans and the like to make their installation or replacement easier.

The device is an easily transportable, lightweight structure that can be transported in the bed of a pickup truck to a jobsite. It is fully adjustable to accommodate a wide range of ceiling heights. It is easily moved through, impediments, such as stairwells and uneven floor surfaces in the work environment. One person can setup and use this device without the need for a second crew member. The device can accommodate drywall sheets of all standard sizes and trimmed or cut sheets equally well. The sheets of material that can be positioned using this device are not limited to drywall or wallboard, panel materials such as acoustic and fireproof sheets can be installed with equal ease.

The inventor believes that this device has many advantages and that there are several objectives fulfilled by this invention. For instance, one object of the invention to provide a device that will allow a single worker to position a sheet of material against, adjacent, or in close vertical proximity to an overhead structure so that the worker can install the sheet of material without the need for assistance from a second worker.

It is also an object of the invention to provide a device for assisting a drywall installer in positioning panels of drywall wherein the device is easily transportable from job site to job site, from one level to another level at a job site, as well as from one room to another room at the site.

It is another object of the invention to provide a device that is easy to set up and "take-down" at a job site.

It is a further object of the invention to provide a drywall handling device that is easily moved from place to place in a room of a building where drywall is being installed as a ceiling surface.

One advantage of the invention presented here is that the device is lightweight, portable, and easily transportable and storable.

Another advantage of the invention is that it allows size adjustments to the device to be easily made through the substitution of readily available and economical tubing.

A further advantage of the invention is that the basic structure of the device is economical as most of the components of the device are commodity tubing available from hardware stores and home improvement centers.

Another advantage of the invention is that it is marketable as a kit of parts that is augmented by purchasing commodity pipe components locally thus reducing manufacturing, packaging, and shipping costs of the kit of parts.

Another advantage of the invention is that it allows the installation of drywall to a ceiling by a single worker.

Also an advantage is that the device is self-supporting either when in use supporting a panel of drywall or when the drywall is removed from the device.

One further advantage of the device is that it is height adjustable in both a macro mode by the use of support tubing of selected sizes and in a micro mode by use of selected sliding tube interactions "pin-in-hole" height adjusters in the structure.

The foregoing objects and advantages of the invention are embedded in the structure claimed and/or methods set forth in the claims appended hereto and forming a part of this disclosure.

The preferred embodiments of the invention presented here are described below in this disclosure and the accompanying drawing figures. Unless specifically noted, it is intended that the words and phrases in the specification, in the Abstract, and the claims be given there ordinary and accustomed meaning as used by those of ordinary skill in the applicable arts. If any special meaning is intended for any word or phrase, the specification will clearly state and define the special meaning.

BRIEF DESCRIPTION OF THE DRAWINGS

Various embodiments of the present invention are described below with reference to the drawings, wherein like designations denote like elements. Similar or "handed" elements may share the same element numbers or may be appended with an alpha indicator to generally refer to similar or identical elements. The invention will be readily understood when the following description is read in conjunction with a perusal of the drawing figures in which.

DESCRIPTION OF A PREFERRED EMBODIMENT OF THE INVENTION

The invention will be understood and its advantages appreciated by a perusal of the attached drawing figures when viewed in light of the teaching provided by this disclosure. An example of a preferred embodiment of the invention is set forth herein, however the inventor contemplates that other embodiments that follow the teaching of the invention are contemplated by the inventor and such other related embodiments are intended to be encompassed by the claims appended to this document.

Figure 1:
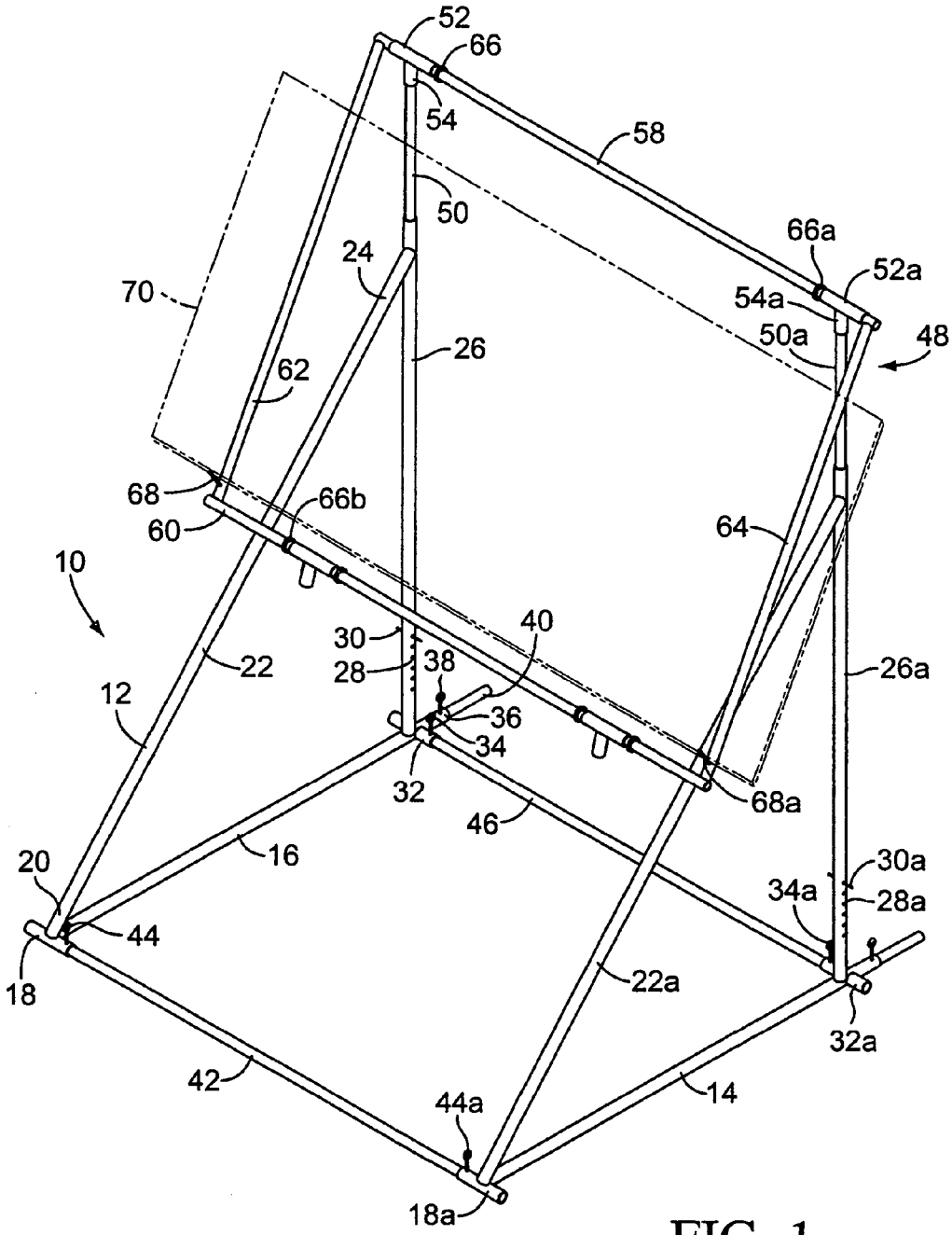
FIG. 1 is a perspective view of the sheet handling device including a sheet of material in a broken line view supported on the device.
Figure 4:
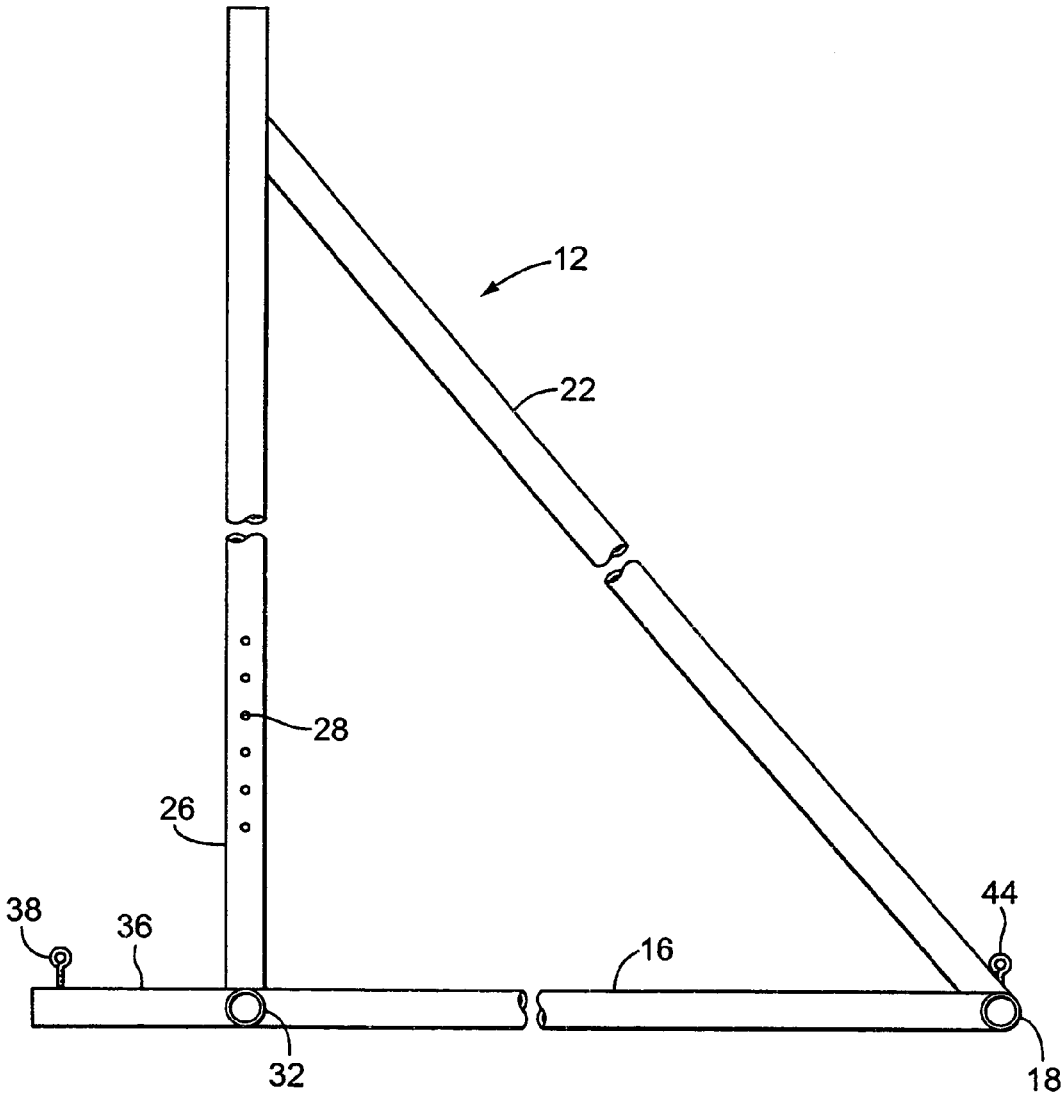
FIG. 4 is a side elevation view of a portion of the base structure of the invention with portions of the tubular elements removed for clarity.

Turning first to FIG. 1, and looking also at FIG. 4, there is shown a positioning device, generally 10, engineered for and helpful in positioning a sheet of material proximate structural elements of a ceiling so as to enable a single person to position and install the sheet of material to structural elements of the ceiling. The device 10, and the base section described below, is comprised of a plurality of tubes connected together in an adjustable arrangement. The arrangement of tubes includes a first side triangle 12 and a second side triangle 14. The first side triangle comprises a base stringer 16, the base stringer being preferable a round tube but equally functional if configured as a rectangular tube, or a stringer of any other cross sectional shape. Returning to the description of the preferred embodiment the base stringer 16 is attached to a first forward stabilizer 18 at the forward end of the base stringer 16. A first end 20 of a diagonal stringer 22 is fixedly attached to the forward stabilizer 18 and extends upwardly and rearwardly from the forward stabilizer 18. The upper end 24 of the diagonal stringer 22 is attached to the upper end of a first vertical tube 26. The lower or bottom end of the first vertical tube is attached to the base stringer 16 at a point spaced away from the forward stabilizer 18. A series of holes, one of the series shown as 28, is provided through the first vertical tube 26. These holes go all the way through the first vertical tube such that a height selection pin 30 can be positioned through the first vertical tube as seen in FIG. 1. A rear stabilizer 32 is attached to the base stringer 16. The rear stabilizer 32 includes a through bore passing transverse and generally perpendicular to the base stinger 16. A thumb screw 34 is threaded into a threaded bore of the rear stabilizer. As shown, an optional bore providing element 36, also having a threaded bore to accept a threaded thumb screw 38, may be provided to accommodate a stabilizer extension 40. The stabilizer extension 40 is an element that can fit into the optional bore providing element 36 and be restrained in place by the thumb screw 38 to add further stability to the device.

In one embodiment of the invention the included angle between the base stringer 16, having a nominal length of 54.5 inches for example, but in no way limited to this length, including the length of the length of the bore providing element 36, and the diagonal stringer 22, having a nominal length of 72 inches, again a nominal length that can be any length as appropriate to connect diagonally between the base and the vertical tubes, is approximately but not limited to, 40 degrees while the included angle between the diagonal stringer 22 and the first vertical tube, of a length of about 60 inches, again not limited to 60 inches but set out here as an example, including the length above the juncture with the diagonal stringer, is about, but not limited to, 50 degrees. The included angle between the first vertical tube 26 and the base stringer 16 is about, but not limited to, a right angle. The length of the bore providing element 36 is about, but not limited to, 7 inches. The length of the first vertical tube 26 above the juncture with the diagonal stringer is about, but not limited to, 5 inches. All of these dimensions are modifiable to provide side triangles that are functional for an overall envelope size of the device. For instance, the diagonal stringer can be longer or shorter and the angles formed with the base stringer 16 and the first vertical tube 26 can be changed as long as the general structure as illustrated is maintained. The nominal dimensions are provided as an illustration of the general size of a working embodiment as designed, constructed, and used by the inventor.

Item 12, the first side triangle, is discussed above. The second side triangle, item 14, is a mirror image of the first side triangle 12 therefore each of its elements and components are similar to those of the first side triangle except that that threaded bores for the thumb screws such as the one in the forward stabilizer 18 and thumb screw 34 are face inwardly as shown in FIG. 1. Like parts are identified using the same element numbers with an alpha extension as necessary.

The first and second forward stabilizers, 18 and 18*a* respectively, are configured to have a cavity through which a forward transverse stringer 42, such as a pipe shown in FIG. 1, can slide until restrained in position by a retainer such as thumb screw 44 or 44*a*.

A rear transverse stringer 46, similar to the forward transverse stringer 42, is positioned to slidably move through the rear stabilizers 32 and 32*a* until restrained from movement through the stabilizers by tightened thumb screws 34 and 34*a*. These forward and rear transverse stringers 42 and 46 provide portability to the device. That is, the forward and rear stringers are removable from the forward stabilizer 18 and the rear stabilizer 32, so that the device is easily disassembled for transportation and storage.

Figure 2:
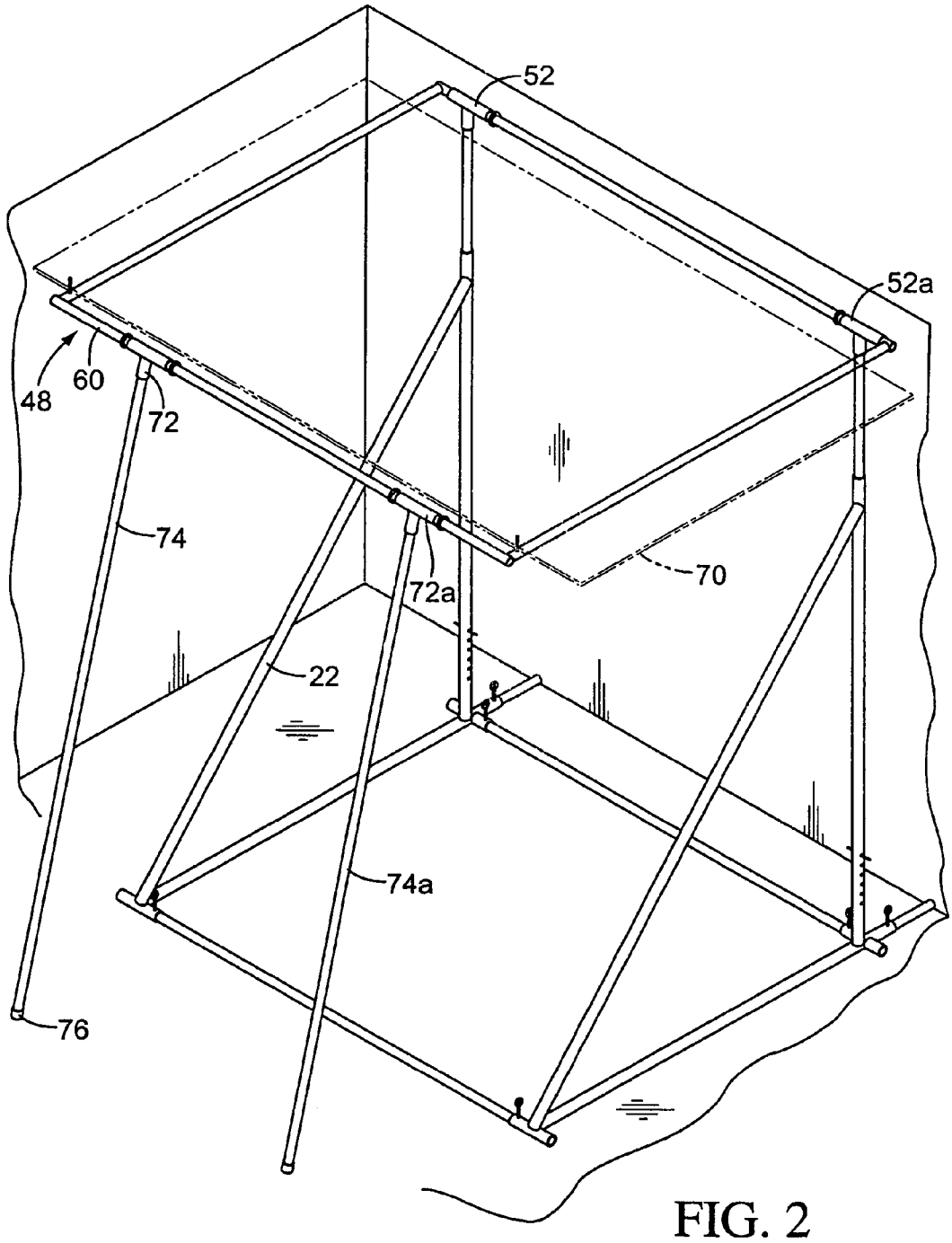
FIG. 2 is a perspective view of the sheet handling device in a position supporting the sheet of material in broken line view proximate a ceiling (not shown)
Figure 3:
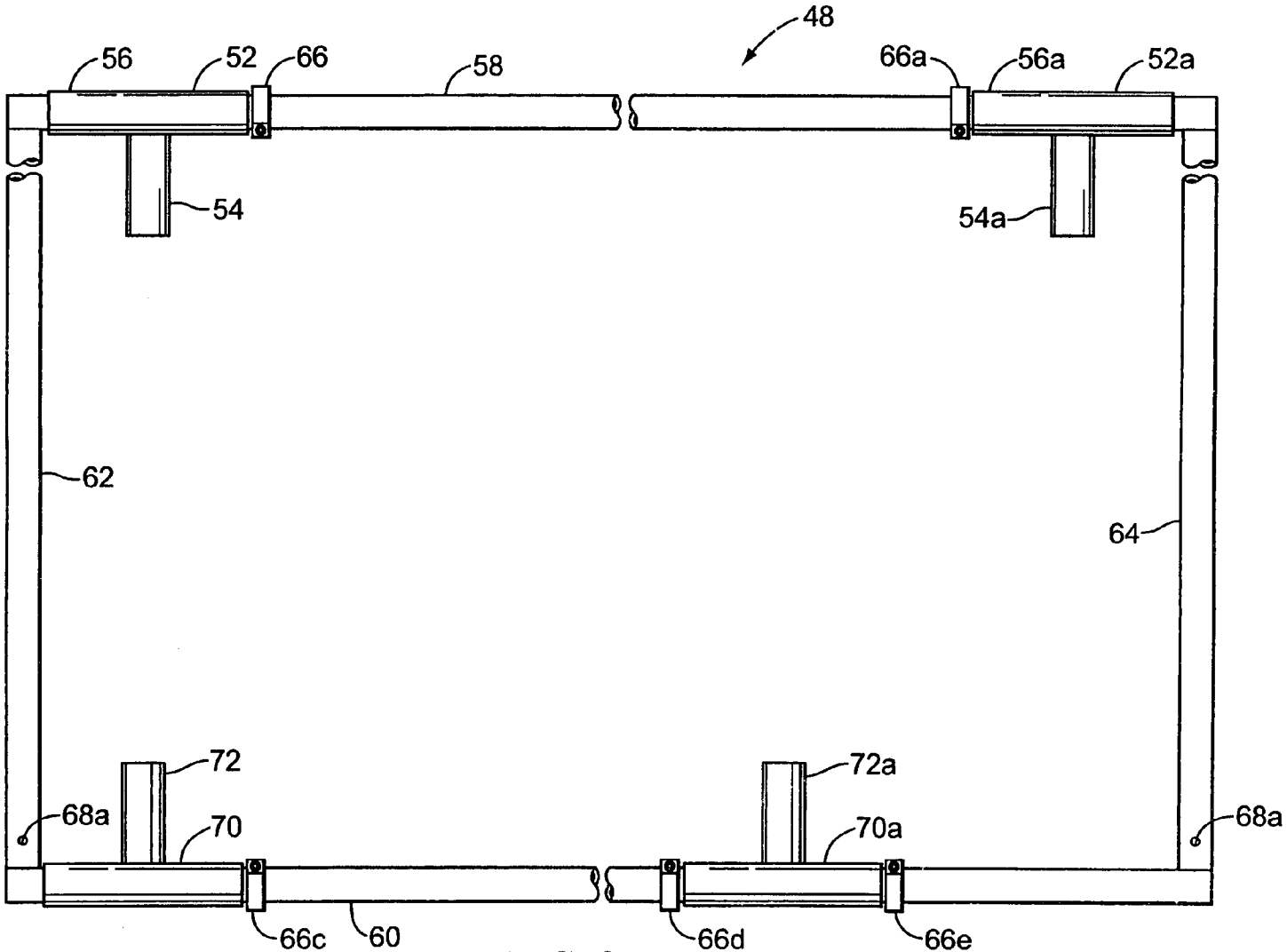
FIG. 3 is a top view of the sheet supporting element of the device with tube sections foreshortened by removal of portions of the tubes for clarity.

A second major component of the device is the pivoting sheet support generally 48 as seen in FIGS. 1, 2 and 3.

The pivoting sheet support 48 is supported on first and second slidable vertical tubes 50 and 50*a* which are slidably carried in the first vertical tube 26 and the second 26*a* vertical tube respectively. The first and second slidable vertical tubes 50 and 50*a* "bottom out" on the pins 30 and 30*a* which are set to yield a length of protruding slidable vertical tube that will position the pivoting sheet support 48 proximate to a ceiling structure to which a sheet of material will be attached. Repositioning the pins 30 and 30*a* will generally lower the pivoting sheet support 48 from the position shown in FIG. 1. In an alternative embodiment the series of holes in each of the vertical tubes 26 and 26*a* can be located vertically higher on the tubes 26 and 26*a*. This would allow shorter slidable vertical tubes 50 and 50*a* which could be lighter, cheaper and less cumbersome.

The slidable vertical tubes 50 and 50*a* fit into first and second journalled hinge elements 52 and 52*a*. These journalled hinge elements each have a slidable vertical tube receiver 54 and 54*a* that accommodates the upper end of the slidable vertical tubes 50 and 50*a*. In one embodiment the slidable vertical tube receiver is made of 1¼ inch tube stock having a wall thickness of 1/16 inch to thus accommodate the 1 inch outside diameter slidable vertical tubes 50 and 50*a*. The transverse components, 56 and 56*a*, of the journalled hinge elements, generally affixed perpendicularly to the slidable vertical tube receivers, is also comprises a 1¼ inch tube having 1/16 inch wall thickness. All of these dimensions are nominal examples and changeable, either to larger or smaller tube sizes, tube sizes mentioned here are illustrative of the tubes used in a preferred embodiment.

A frame comprising a rear frame member 58, a front frame member 60, and left and right side frame members 62 and 64, is provided to support the sheet of material. The rear frame member 58 is journalled through the first and second hinge elements 52 and 52*a* as shown in the figures. The hinge elements are slidably carried on the rear frame member and are restrained from inboard movement by the split collars such as 66 and 66*a*.

Each of the left and right frame members are provided with a pin 68 and 68*a* toward the front frame member 60. The pins, which could be of any of several different shapes such as round or rectangular tube stock welded or otherwise fastened to the left and right frame members, or threaded bolts for instance, support the sheet of material, here shown in a broken line representation as 70 as seen in FIG. 1. In the embodiment shown the pin is of 1 inch in diameter and about two inches long with some of this length extending into the frame members.

Returning to frame, it is seen that there are two more tube receivers 72 and 72*a* journalled on the front frame member 60. These tube receivers are, in this embodiment, made up of 6 inch long pieces of 11 inch tubing having 1/16 inch wall thickness, so that they are slidable on the 1 inch outside diameter tubing of the front frame member 60. Extending outwardly, generally at right angles to the 6 inch tubing elements, are 3 inch long, 1½ inch outside diameter, ⅛ inch wall tubing stubs 74 and 74*a*. The inside diameter of these stub elements is then 1 inch which provides a snug fit with the legs 76 and 76*a* as shown in FIG. 2. (Again, as set forth above, these dimensions are nominal examples and changeable, either to larger or smaller tube sizes.) The position of these legs is determined by the location of the split collars 66*b*-66*e* which grip the front frame member 60 as shown in FIGS. 1-3.

The bottoms of the legs 76 and 76*a* may be provided with end caps such as 78 to provide a non-slip interface with a floor while protection the floor surface and the ends of the legs.

Figure 3A:
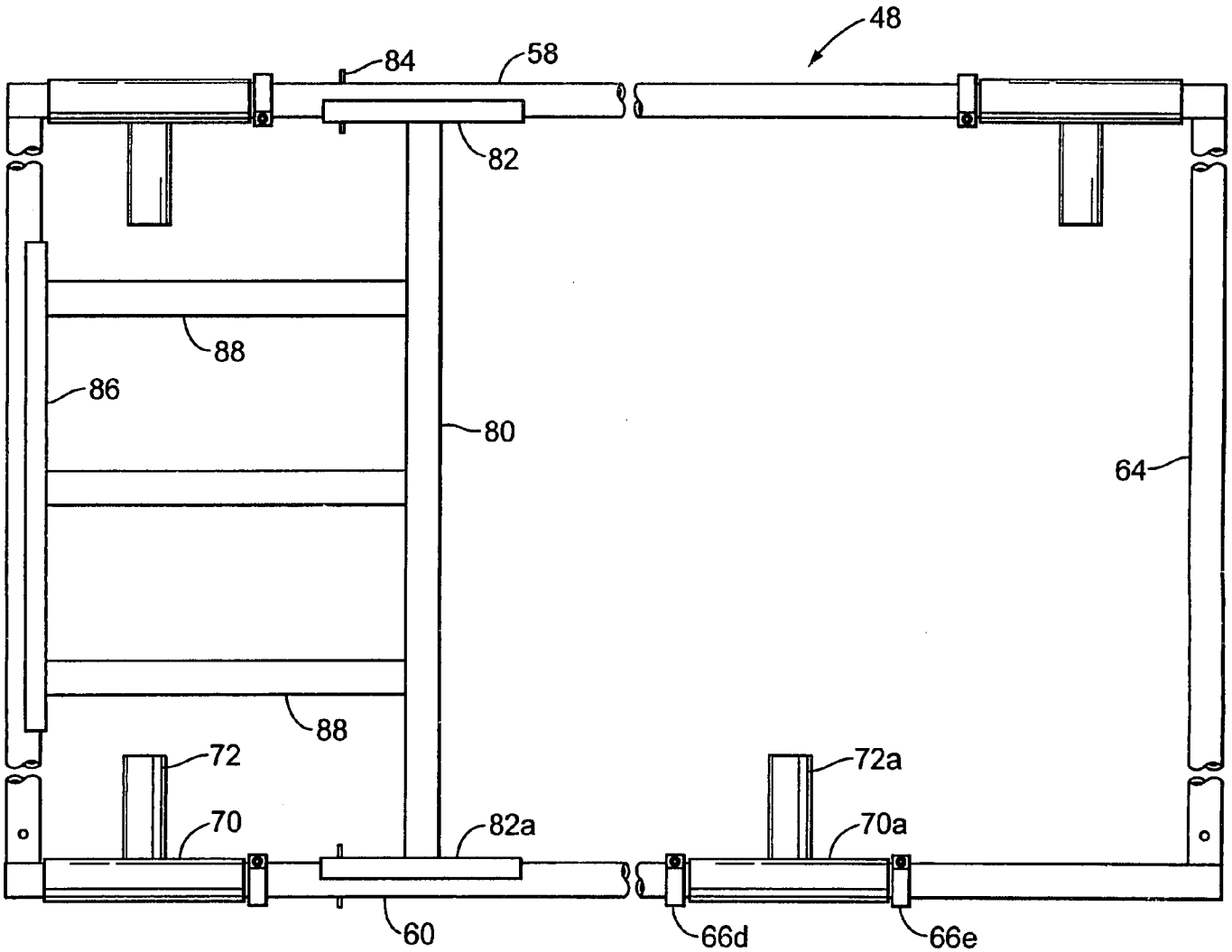
FIG. 3A is a top view of the device set forth in FIG. 3 having additional support structure in place on the frame for use with other than flat sheet material.

FIG. 3A is an enhanced embodiment of the structure shown in FIG. 3. In the installation of ceiling drywall it is often necessary to also install lighting fixtures, chandeliers, ceiling fans, ventilation panels and the like. Heavy or cumbersome fixtures, such as chandeliers and ceiling fans, have to be supported as they are wired to electric drop boxes mounted in the ceiling. The modification, generally a fixture shelf, shown in FIG. 3A, to the basic device shown in FIG. 3, is provided to support a fan, chandeliers, ceiling fixture or the like thus giving a technician an opportunity to "wire" the fixture to the electrical drop while the fixture is supported on the device.

The device in FIG. 3A includes the structure shown in FIG. 3 and in addition includes tubular beam 80, in this embodiment it is a section of one inch diameter tube extending from a first saddle 82 to a second similar saddle 82*a*. The two saddles are fabricated from one and one-quarter inch tube that is cut in half longitudinally as shown. Each saddle may have an aperture that accommodates a locking pin such as the locking pin 84. The saddles and the tubular beam 80 of the fixture shelf is restrained from transverse movement and from disengagement between the saddles and the rear and front frame members 58 and 60 by the pins such as 84. A saddle beam 86 is located away from the beam 80 by a plurality of transverse fixture tubes such as 88. The transverse fixture tubes, three shown here, may be on eight inch centers as a nominal spacing. The transverse fixture tubes 88 may be one inch tubing connected at their outboard ends to the tubular beam 80 and the saddle beam 86 to provide a fixture shelf approximately 18 inches wide, that is eighteen inches center to center from the saddle beam to the tubular beam.

Details of the device are clearly set forth above and the operation of the device will now be explained. Looking at FIGS. 1 and 2 the device is shown in an operative mode. When a drywall installation technician has a need to hang drywall on an overhead surface he will assemble the device by inserting the forward transverse stringer 42 into the forward stabilizers 18 and 18*a* and the rear transverse stringer 46 into the rear stabilizers 32 and 32*a* and secure them with the thumb screws. The length of the stringers 42 and 46 will be of a length that provides stability to the device. They may be on the order of five feet long in a preferred embodiment, however length is not critical as long as their length allows the vertical tubes 26 and 26*a*, and the slidable vertical tube inserts 50 and 50*a*, to be spaced apart for stability and allow the slidable vertical tube inserts 50 and 50*a* to mate with the first and second journalled hinge elements 52 and 52*a*.

The stabilizer extensions such as 40 are inserted into the bore providing elements such as 36 and restrained by the thumbscrews such as 38 if needed. Where the device needs to "snug-up" against a vertical wall the stabilizer extensions may be omitted.

With the base of the device assembled the two slidable vertical tubes 50 and 50*a* can be inserted into the first and second vertical tubes 26 and 26*a* respectively. Next the pivoting sheet support 48 is attached to the base by passing the slidable vertical tubes 50 and 50*a* into the vertical tube receivers 54 and 54*a*. The height of the pivoting sheet support is then adjusted if necessary by placing the pins 30 and 30*a* into appropriate holes of the set of holes 28 and 28*a*. If a macro adjustment is needed the slidable vertical tubes 50 and 50*a* can be cut shorter or longer replacement tubes can be used. After several uses the drywall installer will have adjusted the device to work with standard ceiling heights and only micro adjustments using the pins 30 and 30*a* will be necessary.

At this point the pivoting sheet support will be able to rest on the diagonal stringers 22 and 22*a*. The legs 76 and 76*a* need not be in place yet. The drywall installer will now place a sheet of material, in this case a piece of drywall, "finished" side against the frame, having a significant size, for instance 4 or 5 feet by 8 or 10 feet and weighing perhaps fifty or more pounds, on the pivoting sheet support where it will be held in position by the pins 68 and 68*a*. The drywall 70 is now pivoted into position just below the ceiling joists or surface to which it will be attached. Basically the pivoting sheet support 48 is moved from the position in FIG. 1 to the position in FIG. 2. As the sheet support is swung upward, pivoting on the first and second journalled elements 52 and 52*a*, the legs 76 and 76*a* are inserted into the stubs 74 and 74*b* of the tube receivers 72 and 72*a*. The legs then support the front end of the pivoting sheet support allowing the drywall installer to have both hands free to secure the sheet of material to the ceiling joists or structure with screws, nails or the like. It is expected that the sheet of material will be slid around on top of the pivoting sheet support by the installer to align the sheet of drywall perfectly in position. This is easily done as all the weight of the sheet is supported on the sheet support. With some prior art devices that rely on a T-shaped support the drywall cannot be easily moved as the T-shaped support has to move with the sheet. Returning to the invention, with the sheet of drywall at least partially fastened, the support device can be removed and located in another location for installation of another sheet of drywall to the ceiling. In limited space situations the legs 76 and 76*a* need to be removed to allow the pivoting sheet support to swing down to a loadable position and at other times there will be clearance in the environment that allows the technician to leave the legs installed.

To use the fixture shelf shown in FIG. 3A, the technician will slide tube 70*a* to the left about thirty inches away from tube 70 and secure it with collars 66*d* and 66*e*. He will then measure and record the height of the fixture to be installed. Next he will lower the rear supports 50 and 50*a* (FIG. 1) and then adjust the legs 76 and 76*a* (FIG. 2), by cutting if necessary, to allow three inches or so of clearance between the ceiling or ceiling box when the pivoting sheet support 48 and particularly, the fixture shelf, is pivoted into position generally horizontal to the ceiling. The fixture shelf can now support the ceiling fan, chandelier, light fixture or the like allowing about three inches of clearance space. This gives the installer about three inches of space to work in while attaching the wire connections. Once the electrical connections are made the fixture is secured to the ceiling the fixture shelf can be rotated out of horizontal. It should be noted that with the fixture shelf positioned at one end of the pivoting sheet support as shown in FIG. 3A there is room to position a step ladder to the open area of the pivoting sheet support to enable an installer to have good access to the work area.

When the installation is complete the device is "broken down" into a number of pieces; usually, the legs, the pivoting sheet support, the two side triangles, with or without the slidable vertical tubes 50 and 50*a* and/or the stabilizer extensions 40; and the forward and rear transverse stringers for easy transportation and loading into a truck.

One feature of the invention is the flexibility provided by the adjustability to the device. Not only is the width of the base portion adjustable by selecting the length of the stringers and sliding the stringers through the stabilizers as necessary, this helps accommodate obstacles (stairwells, built-in benches, floor openings and the like) in the room where the installation is being done, but the height of the pivoting sheet support as well as the position of the legs is also adjustable. The height of the pivoting sheet support is adjustable by selecting the length of the sliding vertical tubes 50 and 50*a* or the location of the same sliding vertical tubes by the pin and hole selection. The length of the legs 76 and 76*a* is determined by selecting legs that are at least as long as necessary and then cutting them to fit if the angular displacement is insufficient to prevent the overextension of the pivoting sheet support. It is noted that each leg is independent of the other. This allows leg positioning to avoid obstructions or holes in the support surface or floor.

One advantage of the invention is that it can be marketed as a kit of parts since some of the devices components are readily available tooling. For instance, a kit of parts may include the two side triangles, the pivoting sheet support, the six thumb screws and the pins 30 and 30*a*. An even more compact kit would include a pair of forward stabilizers, a pair of rear stabilizers with the vertical tubes 26 and 26*a* attached thereto, the pivoting sheet support and the thumb screws and pins. The various tubes could be sourced locally as they are readily available tubing items available in hardware stores, home centers or builders supply centers.

In summary what is a presented in this disclosure is a sheet material handling device that includes a base structure made up of first and a second side triangles. These triangles each have a vertical tube with a lower portion and an upper portion, a base stringer attached to the lower portion of the vertical tube, and a diagonal stringer attached to the base stringer and to the upper portion of the vertical tube. There is a transverse stringer extending from the first side triangle to the second side triangle such that the first triangle and the second triangle are adjustably spaced apart on the transverse stringer. In one embodiment a rear transverse stringer is also provided. This rear transverse stringer extends from the base stringer of the first side triangle proximate the vertical tube thereof to the base stringer of the second side triangle proximate the vertical tube thereof. On this base is carried a pivoting sheet support. The pivoting sheet support has a rear frame member and first and second journalled hinge elements carried on the rear frame member. The hinge elements allow the pivoting sheet support to pivot on the base structure as can be seen in FIGS. 1 and 2. A left and a right frame member is attached to the rear frame member and to the front frame member which is spaced apart from the rear frame member. Tube receivers, having stubs to accommodate legs, are rotatably carried on the front frame member. A pin, or in the embodiment shown in the figures, two pins, are attached to the pivoting sheet support away from the journalled hinge elements carried on the rear frame. These pins will assist in supporting sheet material, such as sheets of dry wall, on the pivoting sheet support. To support the pivoting sheet support when it is pivoted from a non-horizontal position one, or more than one, legs, each removably carried in one of the stubs of the tube receivers are provided. Adjustability of the height of the pivoting sheet support is provided by the slidable vertical tubes carried by the vertical tubes. The slidable vertical tubes may be telescopically carried in the upper end of the vertical tubes. The slidable vertical tubes are then inserted into the journalled hinge elements of the pivoting sheet support. The vertical tubes have a series of aligned through holes and a pin will be inserted in one of the aligned through holes such that the slidable vertical tubes retrained from moving through the full length of the vertical tube by the pin positioned in one of the aligned through holes.

The method of using the device is summarized as follows. A sheet of material can be moved from a non-horizontal position to a generally horizontal position with the sheet material handling device presented herein. The method includes the acts of positioning the pivoting sheet support in a non-horizontal position, placing and restraining a sheet of material on the pivoting sheet support, pivoting the pivoting sheet support from a non-horizontal position to a generally horizontal position by raising the pivoting sheet support as it pivots on the pivotally mounted slidable vertical tubes, and positioning a leg in a tube receiver carried on the pivoting sheet support, the leg supporting the pivoting sheet support in a generally horizontal position.

To accommodate different ceiling heights, herein the ceiling height, for instance ceiling joists or the like, defining a plane to which a sheet of material, such as drywall is to be attached, the slidable vertical tubes are adjusted in the base to raise the pivoting sheet support toward the plane to which the sheet of material is to be attached. Thus a sheet of material carried on the pivoting sheet support will be in close proximity to the plane to which the sheet of material will be attached by the drywall installer. After the drywall is fastened to the plane of the ceiling the pivoting sheet support is pivoted from a generally horizontal position to a non-horizontal position and a subsequent sheet of drywall is placed on the pivoting sheet support.

The Abstract presented above is provided to enable classification personnel of the United States Patent and Trademark Office to quickly determine the nature of the technical disclosure presented in this write-up so that it is properly classified. The Abstract will also assist the public in determining the general technological area addressed. Thus, the Abstract is not intended to define the invention or to limit the scope of the invention in any way. The claims provided, however, are intended to encompass the invention to the fullest extent allowable.

Each variation of the invention is limited only by the recited limitations of its respective claim, and equivalents thereof, without limitation by other terms not present in the claim. Likewise, the use of the words "function" or "means" in the disclosure is not intended to indicate a desire to invoke the special provisions of 35 U.S.C. 112, Paragraph 6, to define the invention. To the contrary, if the provisions of 35 U.S.C. 112, Paragraph 6 are sought to be invoked to define the inventions, the claims will specifically state the phrases "means for" or "step for" and a function, without also reciting in such phrases any structure, material or act in support of the function. Even when the claims recite a "means for" or "step for" performing a function, if they also recite any structure, material or acts in support of that means or step, then the intention is not to invoke the provisions of 35 U.S.C. 112, Paragraph 6. Moreover, even if the provisions of 35 U.S.C. 112, Paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, material or acts for performing the claimed function.

What is claimed is:

1. A sheet material handling device comprising:

a base structure;

a pivoting sheet support mounted to the base structure, the pivoting sheet support having a rear frame member and first and second journalled hinge elements carried on the rear frame member the hinge elements allowing the pivoting sheet support to pivot on the base structure;

a left and a right frame members attached to the rear frame member of the pivoting sheet support;

the pivoting sheet support further having a front frame member spaced apart from the rear frame member and attached to the left and right frame members, the front frame member supporting a tube receiver having a stub, the tube receiver carried on the front frame member and rotatable thereon; and one leg removably carried in the stub of the tube receiver.

2. The invention in accordance with claim 1 wherein the first and second journalled hinge elements are moved transversely on the rear frame member.

3. The invention in accordance with claim 2 wherein one of the first and second journalled hinge elements is restrained from transverse movement on the rear frame member.

4. The invention in accordance with claim 2 further comprising a split collar carried on the front frame member, the split collar located adjacent the tube receiver, whereby the tube receiver is restrained from movement along the front frame member.

5. The invention in accordance with claim 1 further comprising a pin attached to the pivoting sheet support away from the journalled hinge elements carried on the rear frame, whereby the pin will assist in supporting sheet material on the pivoting sheet support.

6. The invention in accordance with claim 1 wherein the base structure comprises;

a first side triangle having;

a vertical tube with a lower portion and an upper portion;

a base stringer attached to the lower portion of the vertical tube; and a diagonal stringer attached to the base stringer and to the upper portion of the vertical tube.

7. The invention in accordance with 6 wherein the base member further comprises:

a rear stabilizer formed at a juncture of the vertical tube and the base stringer;

a bore providing element attached to the base proximate a rear stabilizer;

a stabilizer extension slidably carried in the bore providing element and extendable there from.

8. The invention in accordance with claim 6 further comprising a second side triangle, the second side triangle having;

a vertical tube with a lower portion and an upper portion;

a base stringer attached to the lower portion of the vertical tube; and a diagonal stringer attached to the base stringer and to the upper portion of the vertical tube.

9. The invention in accordance with claim 8 further comprising a rear transverse stringer extending from the base stringer of the first side triangle proximate the vertical tube thereof to the base stringer of the second side triangle proximate the vertical tube thereof.

10. The invention in accordance with claim 9 wherein the first and the second side triangles can be moved toward or away from each other while connected to the transverse stringer and the rear transverse stringer.

11. The invention in accordance with claim 8 further comprising a transverse stringer extending from the first side triangle to the second side triangle wherein the first triangle and the second triangle are adjustable spaced apart on the transverse stringer.

12. The invention in accordance with claim 8 further comprising a slidable vertical tube carried by the vertical tube between the upper end of the vertical tube and a journalled hinge element of the pivoting sheet support.

13. The invention in accordance with claim 12 wherein the vertical tube comprises;

a series of aligned through holes; and a pin inserted in one of the aligned through holes, wherein the slidable vertical tube is retrained from moving through a full length of the vertical tube by the pin.

14. The invention in accordance with claim 12 wherein the leg carried in the tube receiver of the front frame member is of a length sufficient to locate the front frame member of the pivoting sheet support on the same plane as the rear frame member of the pivoting sheet support.

15. A sheet material handling device comprising:

a base structure, the base structure having a first and a second side triangle, each triangle having;

a vertical tube with a lower portion and an upper portion;

a base stringer attached to the lower portion of the vertical tube; and a diagonal stringer attached to the base stringer and to the upper portion of the vertical tube;

a transverse stringer extending from the first side triangle to the second side triangle wherein the first triangle and the second triangle are adjustably spaced apart on the transverse stringer;

a rear transverse stringer extending from the base stringer of the first side triangle proximate the vertical tube thereof to the base stringer of the second side triangle proximate the vertical tube thereof;

a pivoting sheet support mounted to the base structure, the pivoting sheet support having a rear frame member and first and second journalled hinge elements carried on the rear frame member the hinge elements allowing the pivoting sheet support to pivot on the base structure;

a left and a right frame member attached to the rear frame member of the pivoting sheet support;

the pivoting sheet support further having a front frame member spaced apart from the rear frame member and attached to the left and right frame members, the front frame member supporting one or more tube receivers, each tube receiver having a stub, the tube receivers carried on the front frame member and rotatable thereon;

a pin attached to the pivoting sheet support away from the journalled hinge elements carried on the rear frame, whereby the pin will assist in supporting sheet material on the pivoting sheet support; and one or more than one legs each removably carried in one of the stubs of the one or more tube receiver.

16. The invention in accordance with claim 15 further comprising:

a slidable vertical tube carried by the vertical tube between the upper end of the vertical tube and a journalled hinge element of the pivoting sheet support;

the vertical tube having a series of aligned through holes;

a pin inserted in one of the aligned through holes, wherein the slidable vertical tube is retrained from moving through the full length of the vertical tube by the pin positioned in one of the aligned through holes.

17. The method of positioning a sheet of material in a generally horizontal position with a sheet material handling device having a pivoting sheet support carried on an adjustable base including slidable vertical tubes that are height adjustable, the slidable vertical tubes pivotally mounted to the pivoting sheet support, the pivoting sheet support further having a tube receiver and a leg, the method including acts of:

positioning the pivoting sheet support in a non-horizontal position;

placing and restraining a sheet of material on the pivoting sheet support;

pivoting the pivoting sheet support from a non-horizontal position to a generally horizontal position by raising the pivoting sheet support as it pivots on the pivotally mounted slidable vertical tubes;

positioning a leg in a tube receiver carried on the pivoting sheet support, the leg supporting the pivoting sheet support in a generally horizontal position.

18. The method of claim 17 wherein a sheet of material is to be attached to a plane, the method of positioning said sheet of material further including the act of adjusting the slidable vertical tubes in the base to raise the pivoting sheet support toward the plane to which the sheet of material is to be attached, whereby a sheet of material carried on the pivoting sheet support is in close proximity to the plane to which the sheet of material will be attached.

19. The method of claim 18 including the act of pivoting the pivoting sheet support from a generally horizontal position to a non-horizontal position after the sheet of material is attached to the plane.

20. The method of claim 19 further including the act of removing one or more than one of the legs from the tube receivers to enable the pivoting sheet support to attain a non-horizontal position.

* * * * *